US007360548B1

(12) United States Patent
Hinca

(10) Patent No.: US 7,360,548 B1
(45) Date of Patent: Apr. 22, 2008

(54) COMBINATION GRASPING DEVICE AND WALKING CANE WITH DETACHABLE BASE

(76) Inventor: Robert Hinca, N1874 Forest Lake Rd., Campbellsport, WI (US) 53010

( * ) Notice: Subject to any disclaimer, the term of this patent is extended or adjusted under 35 U.S.C. 154(b) by 138 days.

(21) Appl. No.: 11/420,962

(22) Filed: May 30, 2006

(51) Int. Cl.
*A61H 3/02* (2006.01)

(52) U.S. Cl. ..... 135/66; 135/65; 135/70; 294/118

(58) Field of Classification Search ..... 135/65–66, 135/78–79, 84, 16–17; 248/155.1, 155.5; 294/118, 423.39
See application file for complete search history.

(56) References Cited

U.S. PATENT DOCUMENTS 1,089,295 A * 3/1914 Vallier ..... 248/155.1
3,328,066 A * 6/1967 Johnston ..... 294/19.1
3,778,097 A * 12/1973 Dorzan ..... 294/1.4
3,809,421 A * 5/1974 James ..... 294/50.8
3,879,079 A * 4/1975 Nicholas ..... 294/1.4
4,042,270 A * 8/1977 Weiland ..... 294/50.8
D281,108 S * 10/1985 Wilson ..... D30/162
5,350,208 A * 9/1994 Heinrichson ..... 294/1.4
5,392,800 A 2/1995 Sergi
5,692,533 A 12/1997 Meltzer
6,065,787 A 5/2000 Jarosch
D438,371 S * 3/2001 Tong et al. ..... D3/7
6,227,149 B1 * 5/2001 Host et al. ..... 119/867
6,386,216 B1 5/2002 Cubelli
6,488,042 B2 12/2002 Troyer
6,527,321 B1 3/2003 Kuciauskas
6,550,490 B1 4/2003 Morton et al.

* cited by examiner

*Primary Examiner*—Winnie Yip
(74) *Attorney, Agent, or Firm*—John K. McCormick

(57) ABSTRACT

Provided herewith is a walking cane device that converts into a tool for grasping items out of the normal reach of an individual. The device comprises two vertical members, pivotably connected to each other. One end of the device is a handle end and the other end is the tip end. Upon releasing a locking mechanism the handle end can be opened up, thereby opening up the tip end to provide a gripper end for grasping objects distant from the handle end. The gripper end being shaped to provide a flat gripper portion for grasping objects as well as a concave surface portion for gripping cylindrical objects. Upon closing the apparatus, the two vertical members interlock to prevent the members from separation during use as a cane. Also provided is a detachable broader base that can be secured to the tip of the device when utilized as a cane.

20 Claims, 12 Drawing Sheets

COMBINATION GRASPING DEVICE AND WALKING CANE WITH DETACHABLE BASE

FIELD OF THE INVENTION

The invention relates to the field of combination canes and extended grabbing devices for aiding individuals in walking and in assisting a user to grasp objects out of the user's normal reach.

BACKGROUND OF THE INVENTION

As the ranks of the elderly increase with the advancing age of the baby boomers, there exists a wide variety of medical and physical infirmities that can afflict this population. Among one of the more common ailments are those affecting the knees, hips and back that limit the ability of the individual to walk without aid or to bend over to pick up an object lying on the ground. Other groups of individuals with walking difficulties can include those injured by an accident or other medical conditions that make it difficult for them to walk without the aid of a cane of some other type of support. Therefore, a number of prior art canes have been described to provide an individual with a cane and/or a cane that also includes an apparatus, forming a permanent part of the cane, for grasping objects at a distance from the user.

For example, U.S. Pat. Nos. 5,392,800, 5,636,650 and 5,640,985 all describe hollow canes in which tension applied to a cable extending within the hollow cane body causes a grasping arm pivotally mounted near the lower rubber tip of the cane to pivot inward, closing a gap against the rubber tip in order to grasp an object.

Other patents describe a mechanism extending external to the body of the cane for moving a pivotally mounted grasping arm. U.S. Pat. No. 5,176,160 discloses a grasping arm that is pulled into contact with the rubber cane tip by means of a cable extending along the outside of the cane, with the cable being pulled by pivoting a lever near the cane handle.

U.S. Pat. No. 6,527,321 to Kuciauskas discloses a grabber and a combined cane and grabber. In the combined cane and grabber, the cane is made of two pieces such that in one alignment the apparatus acts as a standard cane with a "T" handle. By lifting the apparatus off of the ground and pivoting the two cane halves 360 degrees relative to each other, the apparatus acts as a grabber by utilizing the "T" handle ends as ears and lugs for grabbing objects off of the ground.

U.S. Pat. No. 5,692,533 discloses a walking cane with a larger foot member that includes a plurality of forward and downward integrally dependant legs which rigidly extent from the lower member of the support member. This provides additional support and stability to the base of the cane for elderly and infirm individuals to aid in walking.

All of the patents described above require structural differences between the cane being described and a conventional cane to an extent that a conventional cane cannot be readily modified to perform in accordance with the described invention. What is needed is, however, is a cost effective means to provide those requiring assistance in walking with a walking cane that can be easily converted into a grasping device to allow them to securely grasp and safely hold objects that are out of their normal reach. A further object of this invention is to provide a combination walking cane and grasping device with a means for easily converting the walking cane tip into a broader base for those requiring additional stability when walking.

None of these, or other references known to the inventor, treat the problem addressed by the invention, that is, provide a safe, stable and secure walking cane which provides rigid stationary support, while allowing easy use of the device as a grasping tool.

SUMMARY OF THE INVENTION

The instant invention relates to a walking cane that includes a means for easily converting the cane into a tool for grasping items out of the normal reach of an individual. The cane comprises two substantially vertical members, pivotably connected to each other, each vertical member having an upper end, a lower end and a longitudinal axis thereof. The upper end being the handle end and the lower end being the tip end. Upon releasing a first locking mechanism, the handle end can be opened up, thereby opening up the tip end to provide a gripper end for grasping objects distant from the handle end. The gripper end being shaped to provide a flat gripper for grasping objects as well as a concave surface for gripping cylindrical objects. Upon closing the apparatus and securing the first locking mechanism the two vertical members interlock to prevent the members from separation during use as a cane.

In an additional embodiment, when used as a cane, the tip can be securely placed and held into a separate base that comprises a broader base surface for additional support and stability. To release the cane in order to utilize the gripping features, the user simply presses a foot lever on the base to release the cane from the separate base. The cane can then be opened up to use as a gripper by releasing the first locking mechanism in the cane and gripper device. When the user desires to re-attach the separate base to the cane, they simply close the cane together and push the tip of the cane into the opening of the separate base which secures the cane to the separate base with a second locking mechanism.

Other advantages, features and benefits of the invention will become apparent to those skilled in the art upon reading the detailed description taken in conjunction with the drawings, which are meant to be only exemplary of the invention and not meant to limit the invention as defined by the appended claims.

BRIEF DESCRIPTION OF THE DRAWINGS

The accompanying drawings, which are incorporated in and constitute a part of the specification, schematically illustrate a preferred embodiment of the invention, and together with the general description given above and the detailed description of the preferred embodiment given below, serve to explain the principles of the invention.

DETAILED DESCRIPTION OF THE PREFERRED EMBODIMENTS OF THE INVENTION

Figure 1:
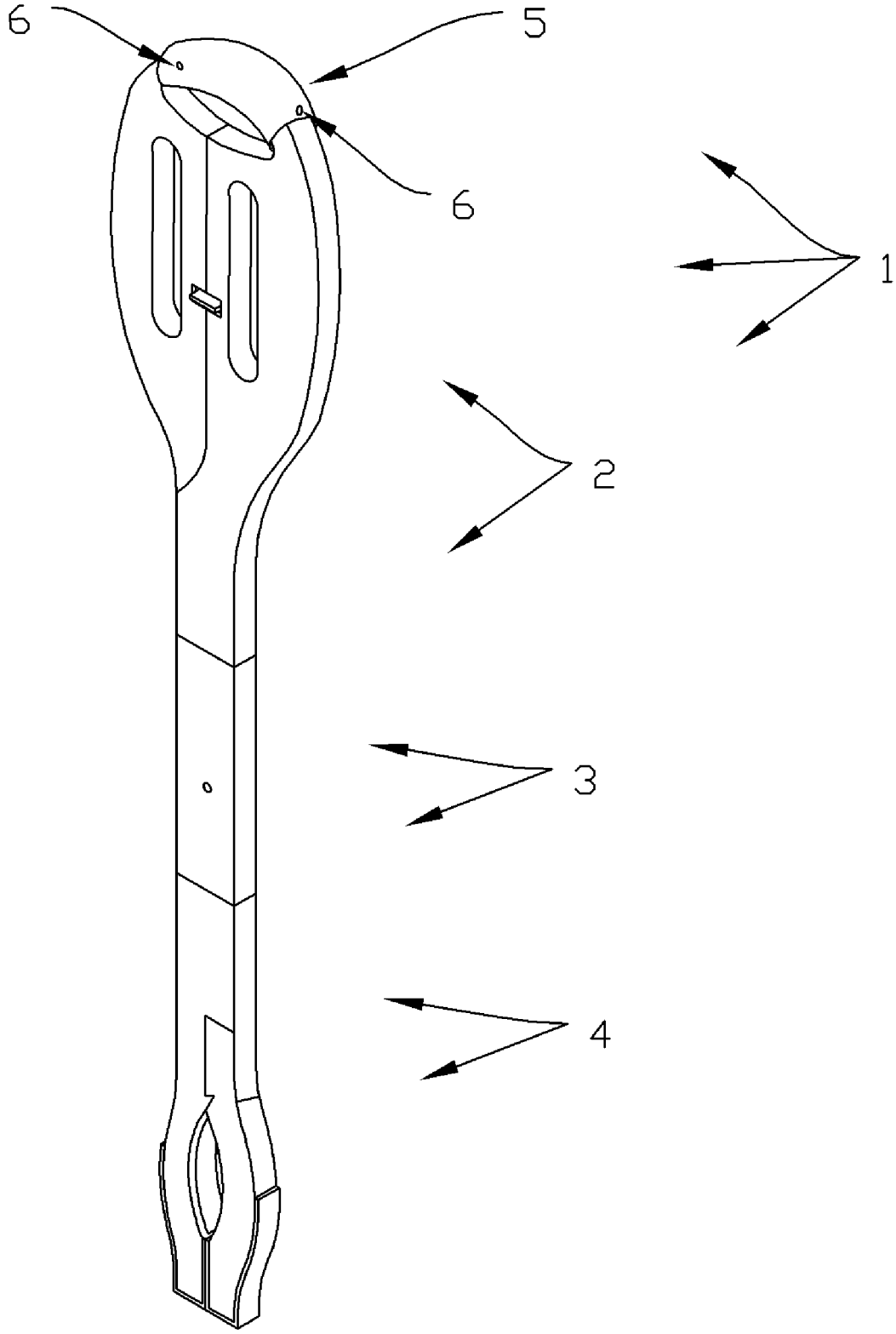
FIG. 1 is a perspective view of the present invention in a closed position.

Reference will now be made in detail to the description of the invention as illustrated in the drawings. Although the invention is described in connection with the drawings, there is no intent to limit the invention to the embodiment or embodiments disclosed therein. On the contrary, the intent is to include all alternatives, modifications, and equivalents included within the scope and spirit of the invention as defined by the appended claims.

FIG. 1 depicts the combination walking cane and gripper 1, which is divided into three sections. These sections are the handle section 2, the middle strut section 3 and the tip and gripper section 4. On the top portion of the handle section 2 is a cane handle gripping pad 5, secured by fasteners 6 to one half of the handle section 2. The cane handle gripping pad 5 provides a secure and comfortable grip to the cane handle section 2 and prevents any pinch points in the handle section 2 when used as a cane to aid in walking.

Figure 2:
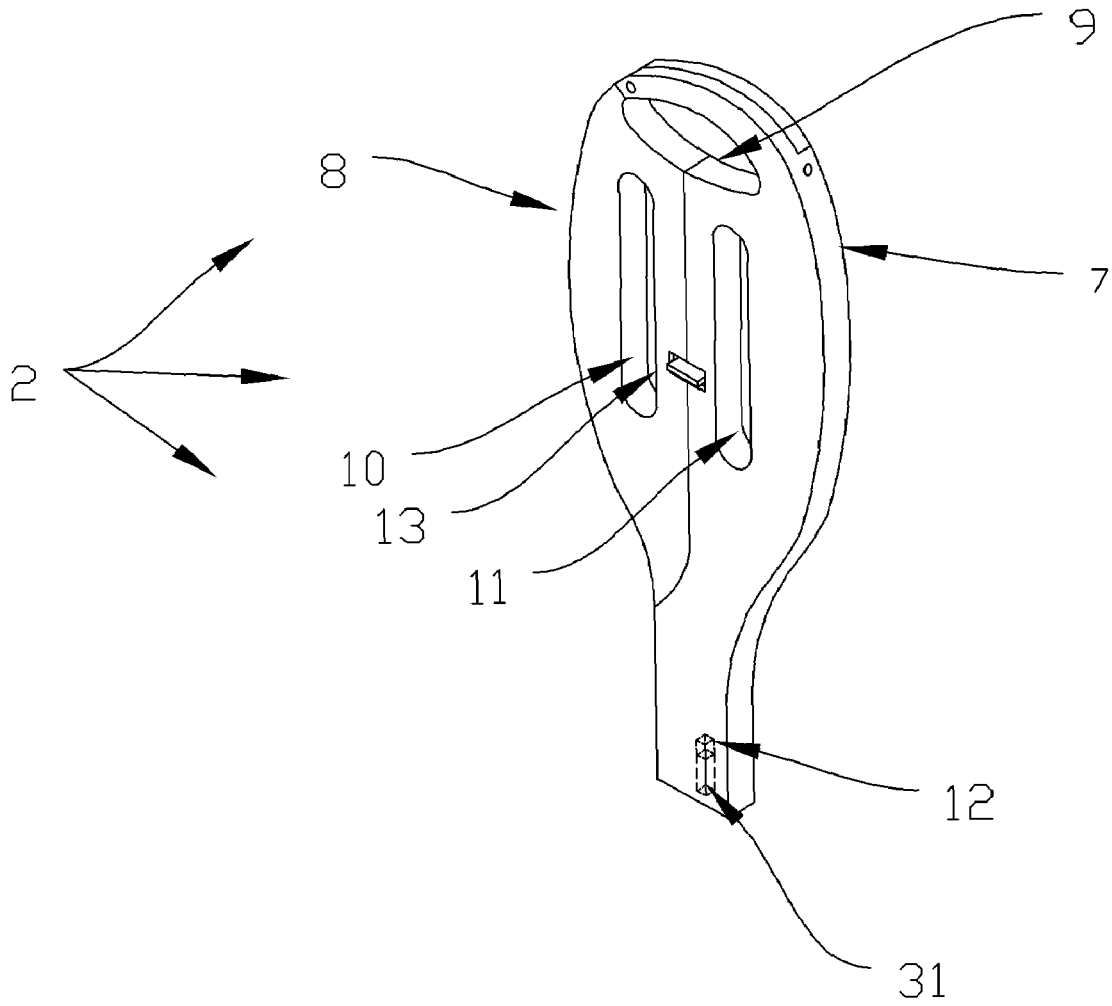
FIG. 2 is a perspective view of the handle portion of the invention in a closed position.

FIG. 2 depicts the cane handle section 2 without the cane handle gripping pad 5. The cane handle section 2 comprises two handle halves 7 and 8. In the top of the handle section 2 there is a first opening 9 to allow the user to grasp the cane 1 in order to use the invention as a cane. There are also second and third openings 10 and 11 to allow the user to insert their fingers in the second opening 10 and their thumb in the third opening 11 when they desire to use the cane and gripper 1 as a gripping device. The base of the handle section 2 includes a hole 33 and a locking hole 12 for receiving a locking bar 30 and a locking tab 33 included on the middle strut section 3 depicted in greater detail in FIG. 5. A locking mechanism 13, used to keep the walking cane and gripper 1 in a normally closed position, is depicted in greater detail in FIGS. 3 and 4.

Figure 3:
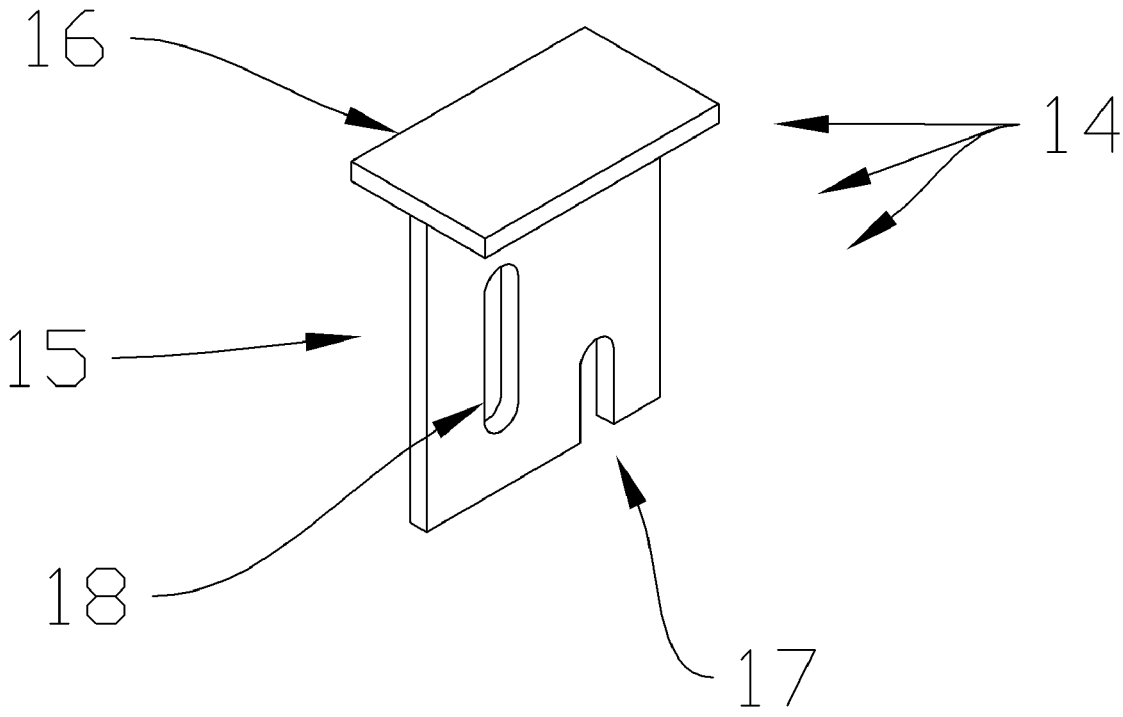
FIG. 3 is a perspective view of a locking tab used in the handle portion.
Figure 4:
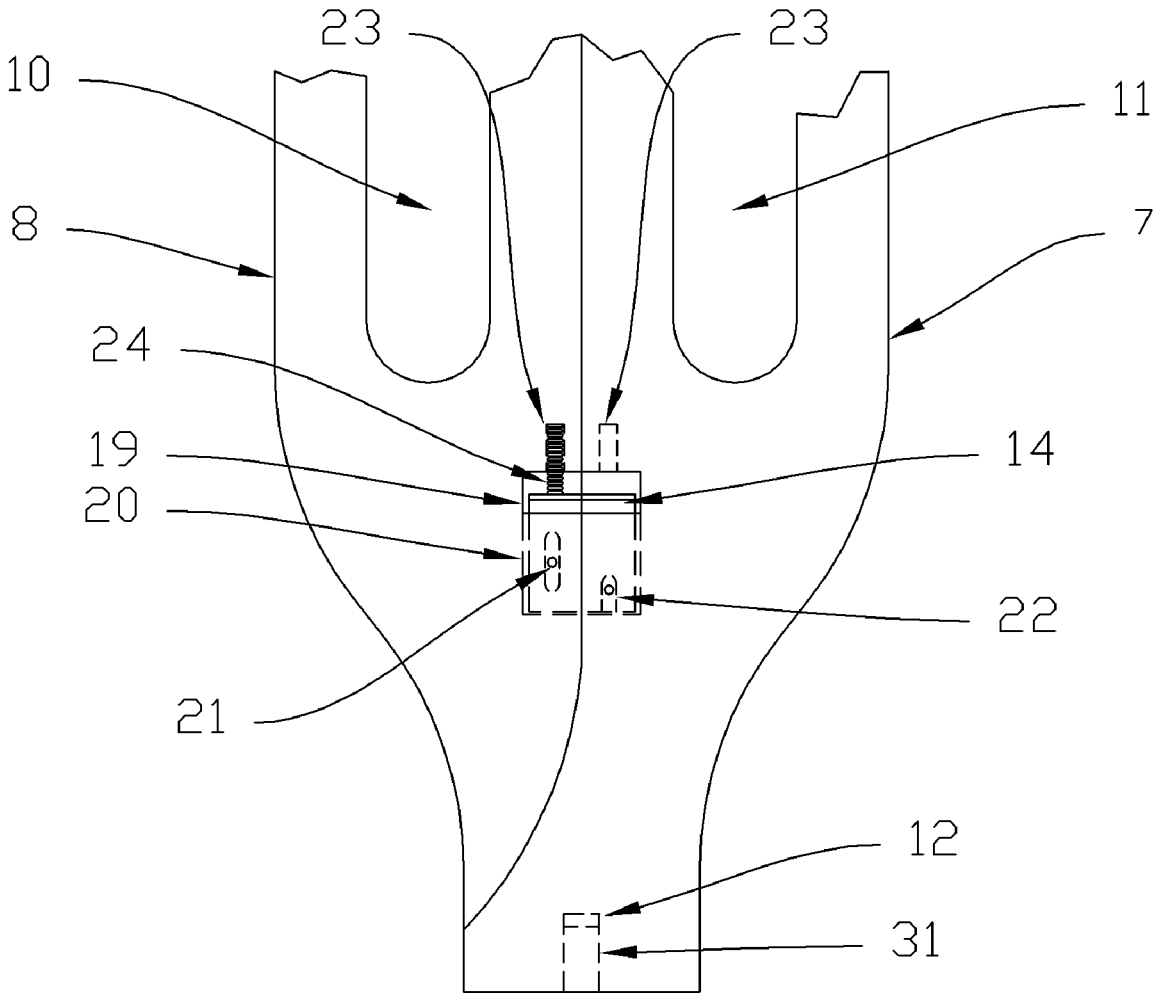
FIG. 4 is a front planar view of the handle locking mechanism.

FIG. 3 depicts a view of the locking hook 14. The locking hook 14 includes a horizontal finger tab 16 and a vertical plate 15. The vertical plate 15 has an open ended slot 17 and a closed slot 18. As shown in FIG. 4, the locking hook 14 is slideably placed into an opening 19 formed in the handle halves 7 and 8. The top portion of the opening 19 goes completely through the handle halves 7 and 8 while lower portion of the opening 19 is an opening slot 20 internal to the handle halves 7 and 8. The locking hook 14 is slideably secured into the handle half 8 with a pin 21 that is secured to the handle half 8 on both sides of the opening 20. A securing pin 22 is secured into the opposite handle half 7 on both sides of the opening 20 and is used to selectively engage the open ended slot 17 in the locking hook 14. A compression spring 24 is fixed in a dead end hole 23 in the handle half 8 to keep the locking hook 14 in a normally biased downward position, thereby engaging the open-ended slot 17 in the locking hook 14 on to the securing pin 22 keeping the handle halves 7 and 8 in a normally closed position to allow the walking cane and gripper 1 to function as a cane. By grasping the handle section 2 by the finger and thumb openings 10 and 11, the user can employ a finger to lift the horizontal tab 16 on the locking hook 14 thereby compressing the biasing spring 24 and releasing the vertical plate 15 from the securing pin 22 allowing the user to open the walking cane and gripper 1 in order to use the walking cane and gripper 1 as a gripper. Other means of selectively securing and releasing the two halves 7 and 8 of the handle section are well known in the art. To close the device and transform the gripper back into a cane, the user lifts the horizontal tab 16, thereby compressing the biasing spring 24, close the two halves 7 and 8 of the handle section together and release the horizontal tab 16 which causes the compression spring 24 to bias the locking hook 14 downward causing the open ended slot 17 to engage the securing pin 22 thereby locking the handle halves 7 and 8 together.

Figure 5:
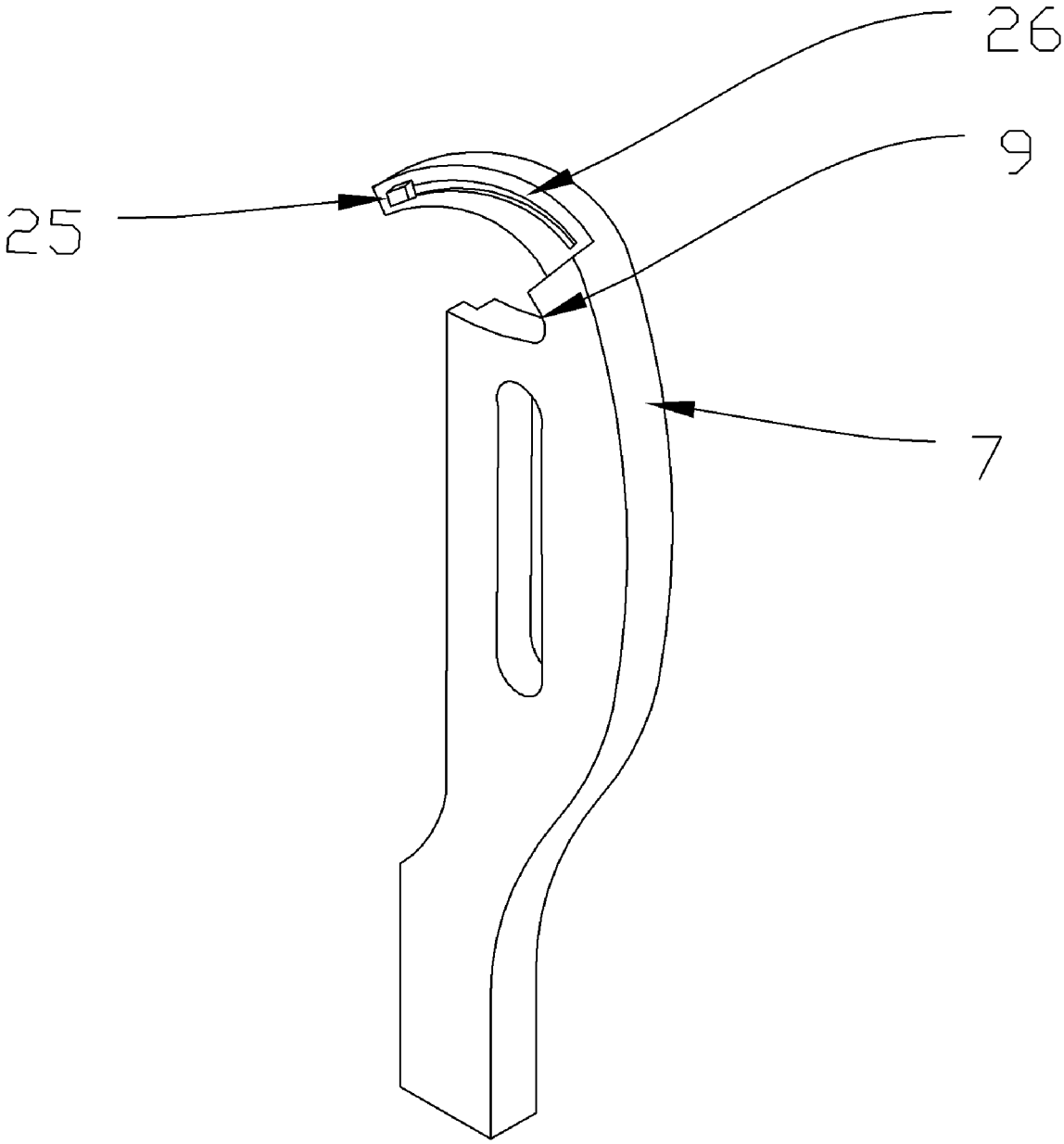
FIG. 5 is a front perspective view of one half of the handle section.

FIG. 5 depicts one view of the inner surface of either of the handle halves 7 and 8. The upper portion of the handle half has a protrusion 25 and a curved slot 26. When the handle halves 7 and 8 are mated together the protrusion 25 on each handle fits slideably into the groove 26 of the other handle half 7 or 8. When the handle gripping pad 5 is placed over the handle halves 7 and 8 and secured to one of the handle halves, 7 or 8, the handle gripping pad maintains the handle halves 7 and 8 in a slidable planar relationship to each other while preventing a pinch point when the handle halves 7 and 8 are moved relative to each other. The protrusions 25 in each handle half 7 and 8 slide in the grooves 26 in the opposing handle haves 7 and 8, being maintained in close proximity to each other by the handle gripping pad 5. The handle halves 7 and 8 have a maximum allowable opening width as defined by the protrusions 25 and the length of the grooves 26. When the handle halves 7 and 8 are opened to their fullest extent, the protrusions 25 sliding in the grooves 26 meet each other and prevent the handle halves 7 and 8 from opening any further.

In an alternative embodiment (not shown), the top of the handle halves 7 and 8 could have a protrusion on the top of the handles 7 and 8 that move slideably inside of a dead-ended groove internal to the handle gripping pad 5, thereby providing a mechanical stop to the width that the handle halves 7 and 8 could open when the protrusions encounter the end of the groove in the handle gripping pad 5. Other means of limiting the amount of opening that the gripper could achieve are known in the art.

Figure 6:
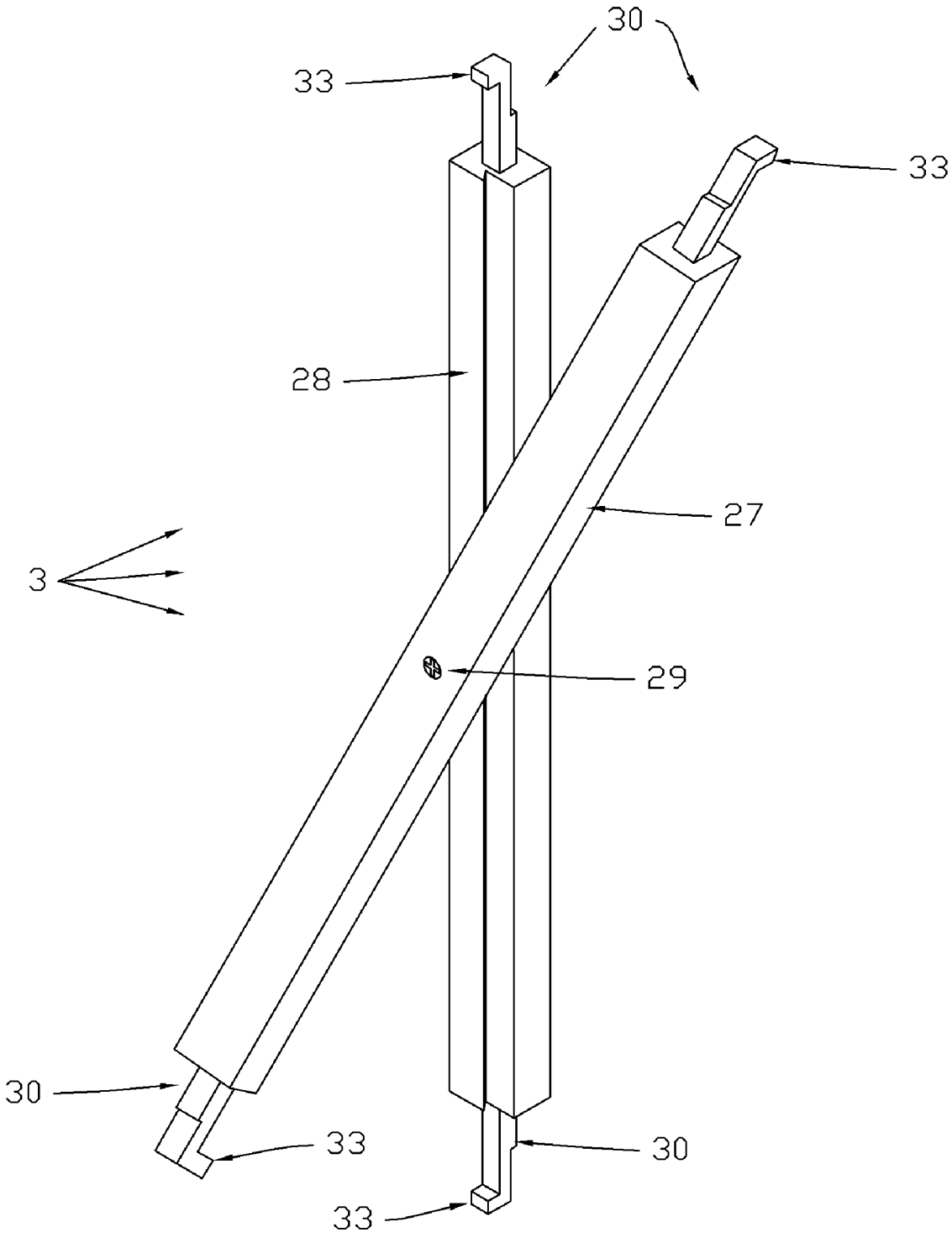
FIG. 6 is a perspective view of the middle strut section of the present invention in an opened position.

FIG. 6 depicts the middle strut section 3 of the walking cane and gripper 1. The middle strut section 3 consists of two vertical halves 27 and 28. The vertical halves 27 and 28 are pivotably secured by a pivot pin 29. Each end of the vertical halves 27 and 28 has integral resilient locking bars 30 and locking tabs 33. These locking bars 30 and tabs 33 are inserted into the holes 31 and the locking tabs 33 engage the locking holes 12 (shown in FIG. 2) in the base of the handle halves 7 and 8 thereby removably fixing the vertical halves 27 and 28 to the handle halves 7 and 8.

Figure 7:
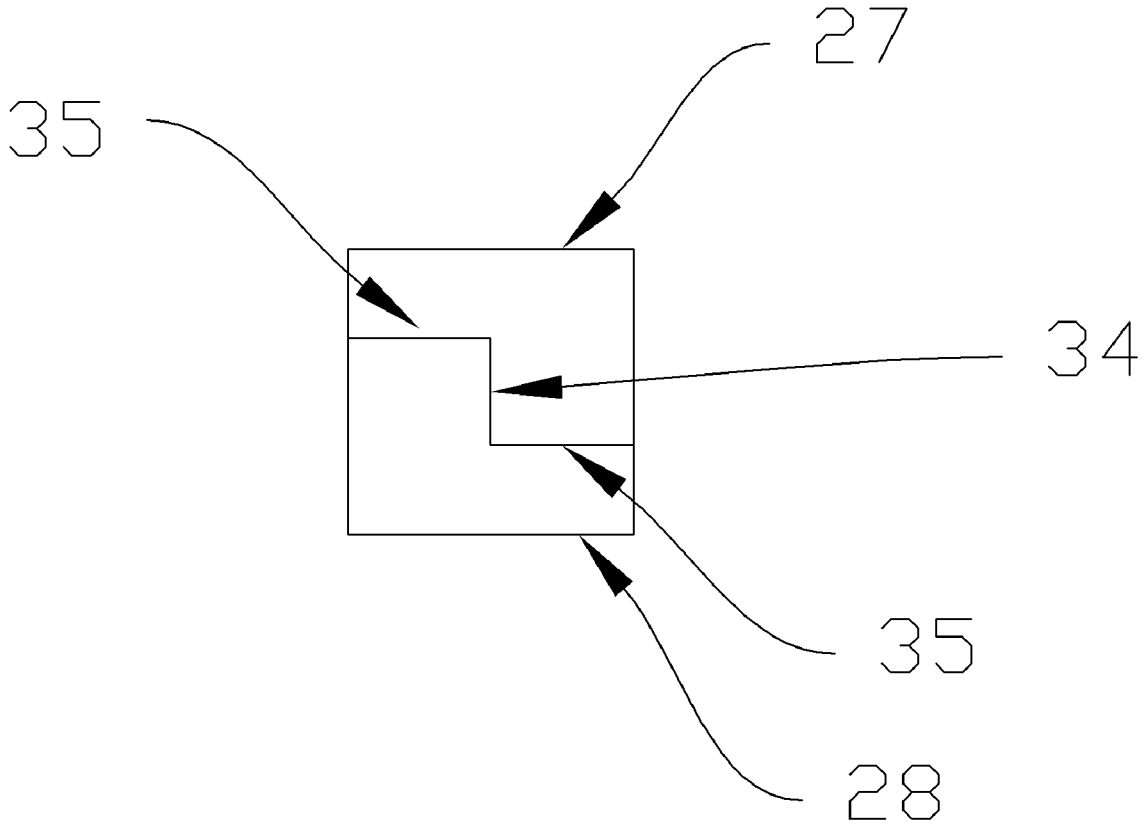
FIG. 7 is a cross-sectional view of one embodiment of the middle strut section of the present invention.
Figure 8:
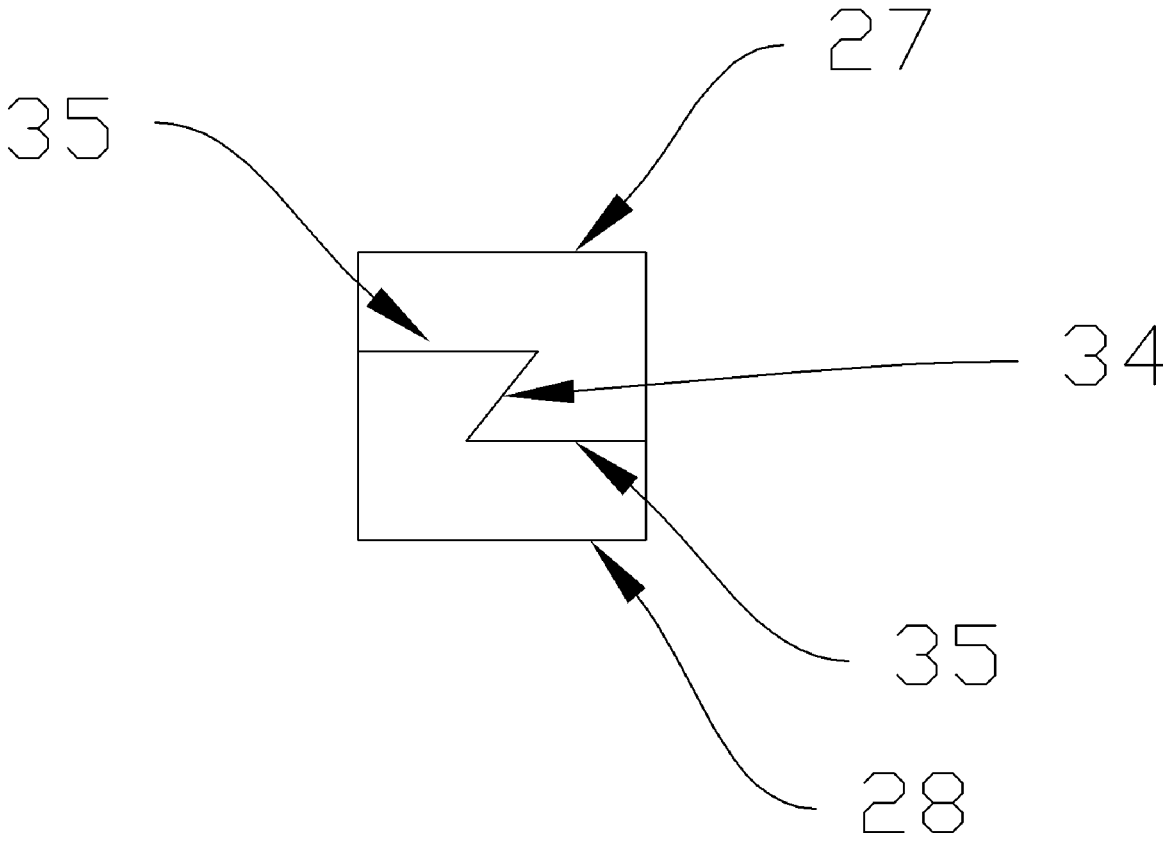
FIG. 8 is a cross-sectional view of a second embodiment of the middle strut section of the present invention.

FIGS. 7 and 8 depict alternative cross-sectional end views of the middle strut section 3. In one embodiment in FIG. 7, vertical halves 27 and 28 are formed in an "L" shape such that the internal mating surfaces 34 and 35 are at right angles to each other. FIG. 8 depicts an alternative embodiment wherein the vertical halves 27 and 28 are formed in a "Z" shape wherein the mating surfaces 34 and 35 are at an acute angle to each other. The embodiment in FIG. 8 would provide additional interlocking support to the vertical struts 27 and 28 to aid in preventing of the struts 27 and 28 from spreading apart or separating away from each other when the walking cane and gripper 1 is utilized as a cane. The same "L" or "Z" shape can be utilized in the design of the handle halves 7 and 8 and in the cane tip and gripper section 4 if so desired.

Figure 9:
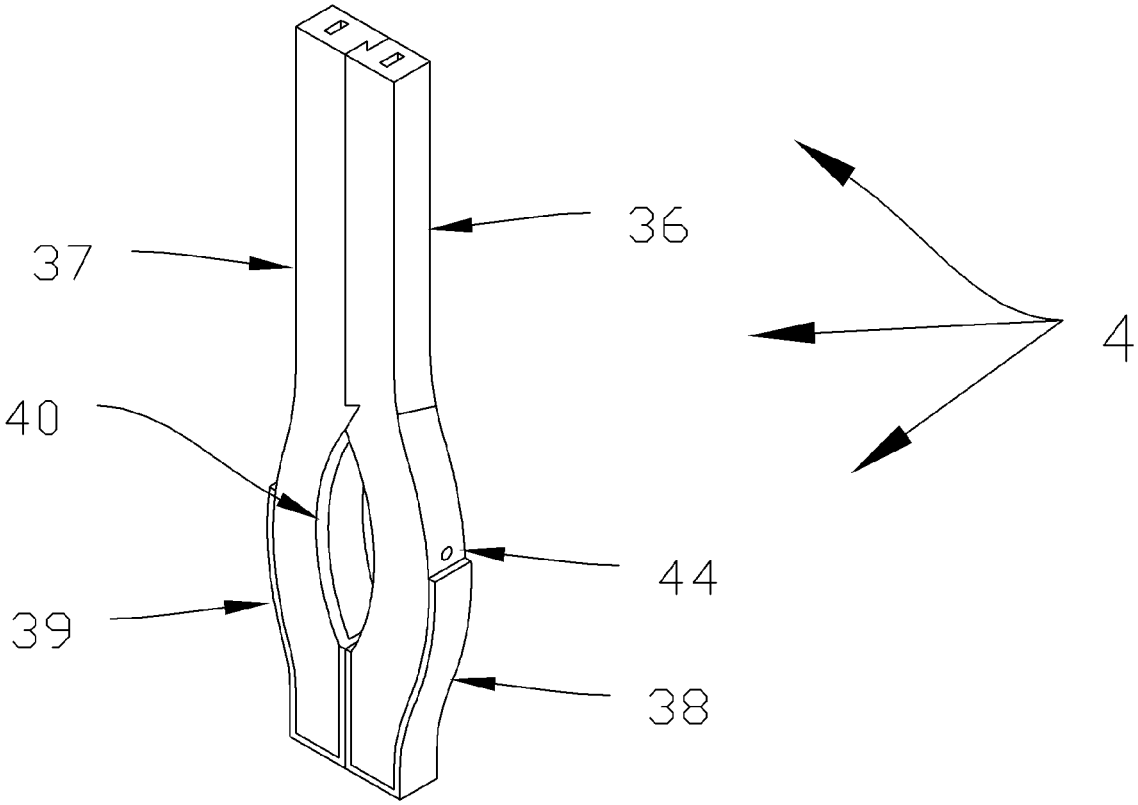
FIG. 9 is a perspective view of the tip section of the present invention in a closed position.
Figure 10:
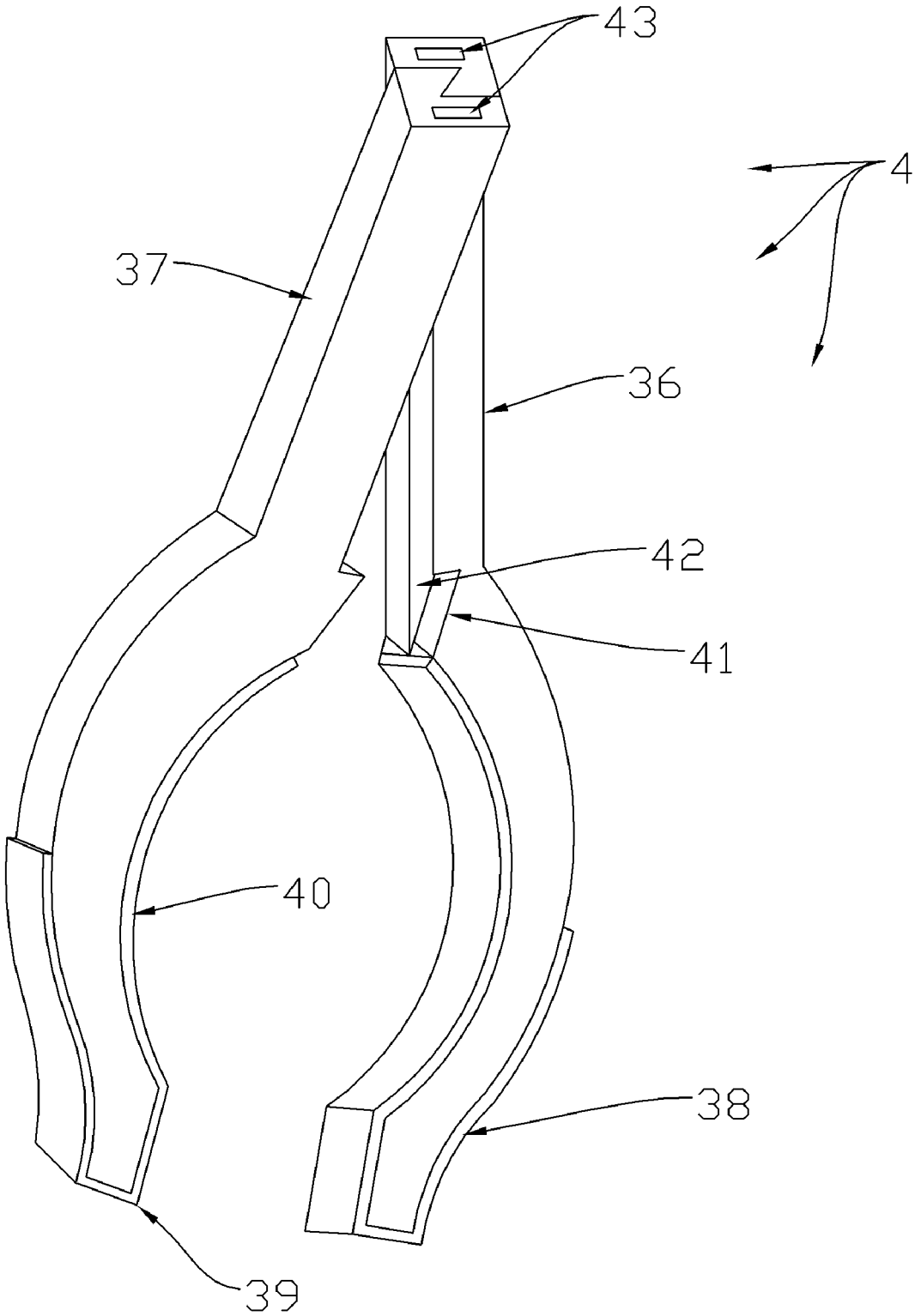
FIG. 10 is a perspective view of the tip section of the present invention in an opened position.

FIGS. 9 and 10 depict the cane tip and gripper section 4 in a closed and opened position respectfully. FIG. 9 shows the two cane tip and gripper halves 36 and 37. Near the base of the cane tip and gripper 4, there is an internal curved portion 40 of the cane tip and gripper halves 36 and 37. This curved portion 40 allows for the gripping of round, tubular or other random shapes. Fixedly attached to base end of the cane tip and gripper halves 36 and 37 and to the inner curved portion 40 is a rubberized or other non-skid material layer 38 and 39 for providing additional gripping action when using the walking cane and gripper 1 as either a cane or as a gripping device.

FIG. 10 depicts the cane tip and gripper section 4 in the open position for use in grasping objects. On each of the cane tip and gripper halves 36 and 37, above the curved portion 40 there is an angular protrusion 42 on one edge and a recessed area 41 on the other edge. When in a closed position, the angular protrusion 42 of one of the halves 36 and 37 interlocks with the recessed area 41 of the other half 36 and 37. This interlocking design aids in preventing the cane tip halves 36 and 37 from separating when in use as a cane. At the top of the cane tip and gripper section 4, there is a hole 43 and a locking hole (not shown) in each end of the halves 36 and 37 similar to the hole 31 and locking hole 12 in the ends of the handle section 2 (shown in FIG. 2) for receiving the locking bars 30 and locking tabs 33 included on the vertical halves 27 and 28 depicted in greater detail in FIG. 5. By inserting the resilient locking bars 30 of the vertical halves 27 and 28 into the holes 43 and 31 in the tip and handle sections 4 and 2 respectively, the handle 2, middle strut section 3 and tip section 4 become removably fixed together for use as either a cane or a gripping apparatus.

Once assembled, the handle section 2 is securely fixed to the middle strut section 3 which is securely attached to the cane tip and gripper section 4. By releasing the locking mechanism 13 located in the handle section 1, the user can open up the cane to use the device as a gripper which is pivoted in the middle strut section 3. By closing the handle and tip sections 2 and 4, engaging the locking mechanism 13 holding the handle halves 7 and 8 together, combined with the interlocking "Z" cross-sectional shape of the handle, strut and tip sections 2, 3 and 4 along with the gripping pad 5 that provides a soft grip and keeps the handle top halves 7 and 8 together, the walking cane and grabber 1 becomes a sturdy and rigid walking cane that can be quickly and easily converted into an extended grabbing devise.

In an alternative embodiment, a handle half 7 or 8, a vertical half 27 or 28 and a tip half 36 or 37 could be made as one continuous piece without the need for assembling the three component parts. Two such continuous pieces could then be pivotably joined proximate the center length of the continuous pieces to create a combination walking cane and grasping device.

In a further alternative embodiment, the non-skid material layers 38 and 39 placed on the tip and the internal curved portion 40 on the cane tip 4 is replaced with a separate non-skid material (not shown) for the internal curved portion and a separate replaceable non-skid material cup portion (not shown) that fits over the end tip for traction with the ground when the device is utilized as a cane. This allows for replacement of the non-skid cup tip portion if it is damaged or wears out through use of the cane.

Figure 11:
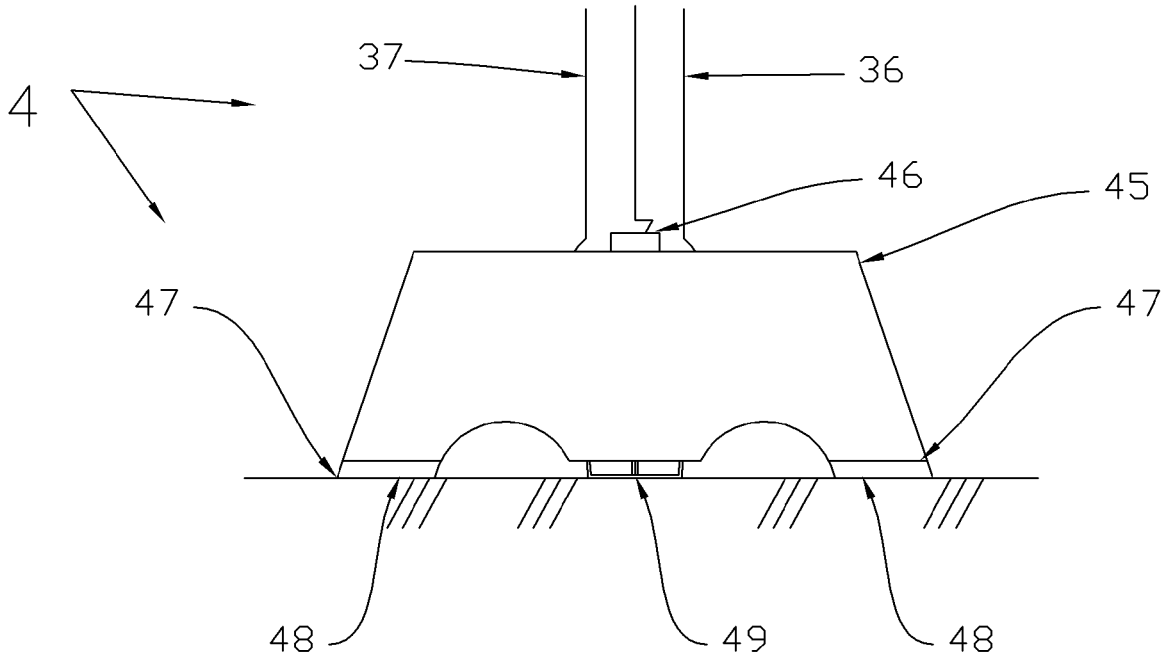
FIG. 11 is a frontal plan view of the tip section of the present invention secured into a broader base.
Figure 12:
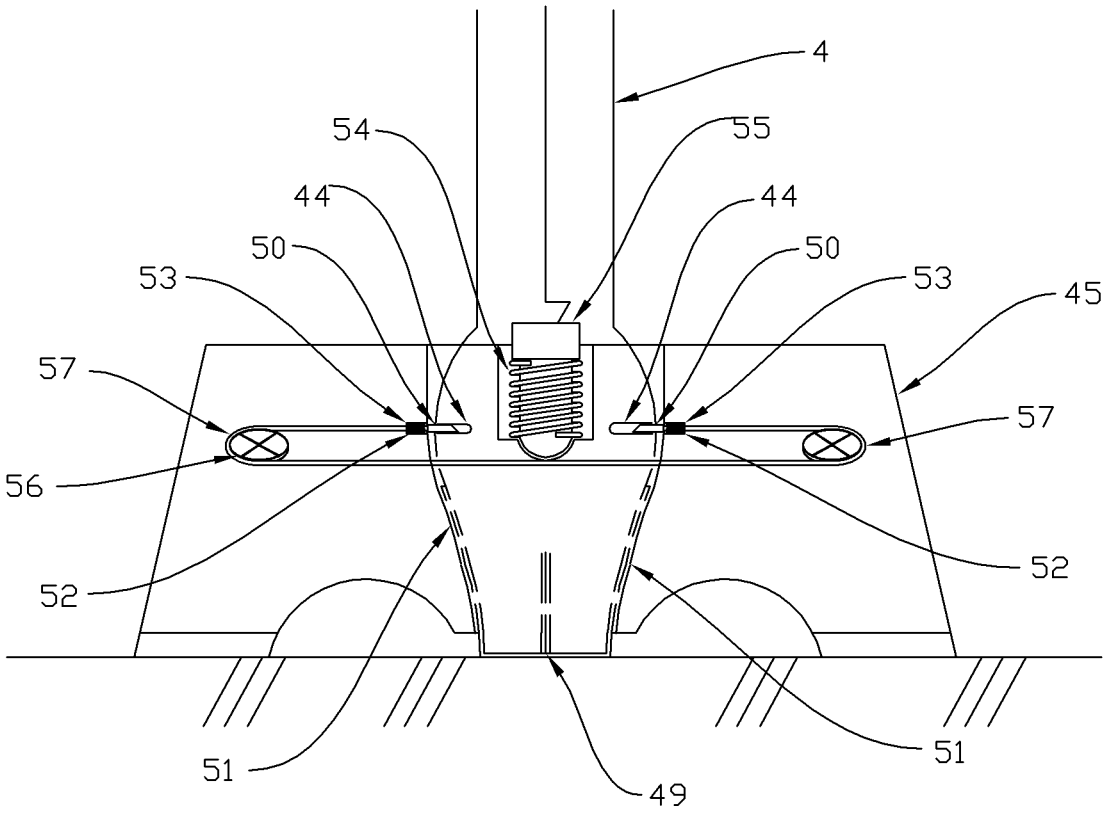
FIG. 12 is a cross-sectional view of the locking and releasing mechanism of the tip section when inserted into the broader base.

In an additional embodiment, shown in FIGS. 11 and 12, the cane tip and gripper section 4 can be removably inserted into a broader base 45. The removable base 45 can be molded out of plastic, resin or other such materials and have two or more feet 47 (only two are shown). Each of the feet 47 can have tips 48 for providing additional traction, such as those made out of rubber or the like. Thus, when the cane tip and gripper section 4 is placed into the base 45, the bottom tip 49 of the cane tip and gripper section 4 is planar with the tips 48 on the legs 47 thereby providing a stable base for the walking cane and gripper 1.

FIG. 12 depicts a cross-sectional view of the broader base 45 with the cane tip and gripper section 4 inserted into the base 45. The inner surface 51 of the base 45 is formed to match the form of the cane tip and gripper end 4. On each side of the cane tip halves 36 and 37, there is a blind hole 44. Mounted into the base 45 are two pins 50 located inline with the holes 44. The tip end of the pins 50 being tapered to allow for easy insertion of the cane tip and gripper section 4. The pins 50 move slideably in holes 52 formed into the base 45. In each of the holes 52 there is a compression spring 53 that biases the pins 50 outwardly. Thus, when the cane tip and gripper 4 is inserted into the base 45, the pins 50 move backwards into the holes 52 as the cane tip is being inserted and then forward into the hole 44 in the cane tip and gripper section 4 when the holes 44 in the cane tip align with the pins 50 thereby locking the base 45 securely to the cane tip and gripper section 4.

To release the walking cane and gripper 1 from the broader base 45, the user depresses the spring 54 loaded button 55 which in turn pushes down on a cable 56. The cable 56 is connected around pulleys 57 to the base of each pin 50. By depressing the button 55, the cable 56 moves downward, thereby causing the pins 50 to be pulled back into the holes 52 in the base 45, which in turn releases the walking cane and grabber 1 from the base 45. Other means of securing and releasing the walking cane and gripper 1 to the base 45 can be easily derived from the concepts presented here by those skilled in the art.

Thus it is apparent that there has been provided, in accordance with the invention, a cane and grabber that satisfies the aims and advantages set forth above. While the invention has been described in conjunction with the specific embodiments thereof, it is evident that there may be many alternatives, modifications and variations that may be apparent to one skilled in the art of the foregoing description. Accordingly, it is intended to embrace all such modifications and alternatives as may fall within the scope and spirit of the appended claims.

I claim:

1. A cane and grasping device comprising:

a. a first strut lying in a first vertical plane having a first handle end and a first tip end, said first handle end having a first open-ended slot in a first horizontal plane and a first closed-ended slot beneath said first open-ended slot in a second vertical plane, said first tip end having a first flat surface in a second horizontal plane parallel to the ground, a second flat surface in a third vertical plane adjacent said first flat surface;

b. a second strut lying in a fourth vertical plane having a second handle end and a second tip end, said second handle end of said second strut having a second open-ended slot in said first horizontal plane and a second closed-ended slot beneath said second open ended slot in a fifth vertical plane, said second tip end having a third flat surface in said second horizontal plane parallel to the ground, a fourth flat surface in a third vertical plane adjacent said second flat surface;

c. a pivotal connection between said first and said second struts proximate the center length of said struts and a releasable locking mechanism at said first and said second handle ends of said first and said second struts, said locking mechanism maintaining said first and said second struts in a normally closed position;

wherein said first and said second struts are in a normally closed position held together by said locking mechanism, said first and said second open-ended slots forming a closed ended slot sized and shaped to receive the fingers and thumb of one hand of a user and enables the combined struts to act as a cane to aid in walking; and wherein said user inserts said fingers and thumb into said first and said second closed-ended vertical slots in said first and said second strut and releases said locking mechanism so that said user can cause said first and said second struts to pivot relative to each other and enables said second and said fourth flat surface to cooperate with each other for grasping objects at a distance from said user, and by pivoting said first and said second struts back together relative to each other, said locking mechanism securing said first and said second struts together thereby converting the grasping device back into said cane.

2. The cane and grasping device as defined in claim 1 wherein said first and second tips comprises:

a. a first curved surface in a sixth vertical plane adjacent and above said second flat surface on said first strut;

b. a second curved surface in a seventh vertical plane adjacent and above said fourth flat surface on said second strut;

wherein said first and said second curved surfaces can be utilized for grasping objects distant from said user when said device is deployed as a grasping device.

3. The cane and grasping device as defined in one of claims 1 or 2 wherein there is a first protective sleeve fixedly attached to said handle end of said first strut and is slidable with respect to said second handle end of said second strut, said sleeve providing a gripping surface when using said device as a cane and preventing said user from encountering any pinch points in said handle ends.

4. The cane and grasping device as defined in any one of claims 1 or 2 wherein said first handle end has a first protrusion and a first horizontal groove above said open-ended slot on the inside of said first handle end and said second handle end has a second protrusion and a second groove above said open-ended slot on the inside of said second handle end wherein said first handle end and second handle end can be moved slideably relative to each other and wherein said first protrusion moves slideably in said second groove of said second handle end and said second protrusion in said second handle end moves slideably in said first groove in said first handle end such that when said first and said second protrusions meet each other the maximum opening width of said first and said second tip ends is determined.

5. The cane and grasping device as defined in one of claims 1 or 2 wherein said first handle end has a first protrusion on the top of said first handle end and a second protrusion on the top of said second handle end, and said first protective sleeve has a dead end groove on the inside of said sleeve for accepting said first and second protrusions wherein said first handle end and second handle end can be moved slideably relative to each other and wherein said second protrusion moves slideably in said groove of said protective sleeve such that when said second protrusion meets said dead end of said groove the maximum opening width of said first and said second tip ends is determined.

6. The cane and grasping device as defined in any one of claims 1 or 2 where the cross-sectional interfaces of said first and said second struts form an interlocking Z shape thereby preventing the struts from separating when said device is utilized as a cane.

7. The cane and gripping device as defined in any one of claims 1 or 2 wherein there is a removably attached broader base for additional stability comprising:

a. at least two legs for contact with the ground, b. a releasable locking mechanism for securing said tip ends into said broader base; and c. a releasing mechanism for releasing said tip ends from said locking mechanism and from said broader base.

8. The cane and grasping device as defined in any one of claims 1 or 2 wherein said first flat surface, said second flat surface, said third flat surface, said fourth flat surface and are lined with a sleeve to provide additional gripping action to said first and third flat surfaces for contact with the ground and to said second and fourth flat surfaces for grasping objects.

9. The cane and grasping device as defined in claim 2 wherein said first flat surface, said second flat surface, said first curved surface, said third flat surface, said fourth flat surface and said second curved surface are lined with a sleeve to provide additional gripping action to said first and third flat surfaces for contact with the ground, to said second and fourth flat surfaces for grasping objects and to said first and second curved surfaces for grasping objects.

10. The cane and grasping device as defined in claim 2 wherein said first flat surface, said second flat surface, said third flat surface and said fourth flat surface are lined with a first replaceable sleeve to provide additional gripping action to said first and third flat surfaces for contact with the ground when said device is utilized as a cane and wherein said first curved surface and said second curved surface are lined with a second sleeve to provide additional gripping action and to said first and second curved surfaces for grasping objects.

11. A method for using a walking cane as an aid in walking and for converting said walking cane into a grabber for grasping objects at a distance from a user comprising:

a. pivotally connecting two struts together proximate the center length of said struts;

b. securing said struts in a normally closed position with a releasable locking mechanism;

c. providing one horizontal opening for a first handle grasping end at a first end of each of said struts:

d. providing a tip end at a second end of each of said struts;

e. grasping said first handle grasping end and utilizing said device as a walking cane;

f. providing a vertical opening for a second handle grasping end at a first end of each of said struts;

g. providing gripping ends at the second end of said struts;

h. grasping said second handle grasping ends;

i. releasing said locking mechanism that holds said struts normally closed;

j. separating said second handle ends of said struts thereby separating said gripping ends of said struts;

k. moving said gripping ends to a first position in contact with said object desirous of being grabbed;

l. closing said second handle ends together thereby closing said tip ends together and grasping said object;

m. moving said tip ends to a second position and separating said second handle ends thereby separating said gripping ends and releasing said object; and n. closing said second handle ends together and engaging said locking mechanism thereby returning said struts to a normally closed position for use as a walking cane.

12. The method of claim 11 further comprising:

a. providing gripping sleeves at said gripping end of said struts for added traction with the ground and for grasping objects; and b. providing a user gripping sleeve above said horizontal opening for ease of grasping said first handle grasping end.

13. The method of claim 11 further comprising:

a. providing gripping pads for added traction when grasping objects;

b. providing a replaceable traction tip cover for said tip ends; and c. providing a user gripping sleeve above said horizontal opening for ease of grasping said first handle grasping end.

14. The method as defined in any one of claims 11 through 13 further comprising a cross sectional "z" shaped interface between said two struts to prevent said struts from separating when used as a walking cane.

15. The method as defined in any one of claims 11 through 13 further comprising a removable broader base for added stability, said broader base comprising:

a. providing at least two legs for contact with the ground;

b. providing a releasable locking mechanism for securing said tip ends into said broader base; and c. providing a release mechanism for releasing said tip ends from said locking mechanism and from said broader base.

16. A walking cane device that converts into a grasping device and then converts back into a walking cane comprising:

a. a means for pivotally connecting two struts together proximate the center length of said struts, b. a releasable locking means for maintaining said struts adjacent to each other in a normally closed position when said cane device is utilized as a walking cane;

c. a first handle means for grasping said cane device when used as a walking cane;

d. a first tip means for engagement with the ground when said cane device is utilized as a walking cane, said first tip means comprised of the combined two tips of said two struts;

d. a second spreadable handle grasping means for grasping said struts when used as a grasping device;

e. a means for releasing said releasable locking means thereby allowing said two struts to pivot relative to each other by separating and closing said second spreadable handle means thereby allowing a user to utilize the inside of said two strut tips to grasp and release objects at a distance from said user; and f. closing said two struts to a normally closed position and a means to engage said releasable locking means thereby converting said grasping device back into said walking cane device.

17. The walking cane that converts into a grasping device and then converts back into a walking cane of claim 16 further comprising:

a. a means for a non-skid surface material to be attached to said two tips and to said inside of said two strut tips to aid in providing traction to said ground when said walking cane is used as a walking cane to and to aid in grasping objects when said walking cane is used as a grasping device; and b. a means for attaching a handle grasping surface to said first handle to provide for a non-slip grip.

18. The walking cane that converts into a grasping device and then converts back into a walking cane of claim 16 further comprising:

a. a means for a first non-skid surface material to be attached to said inside of two strut tips for use in providing additional traction when grasping objects;

b. a means for a replaceable second non-skid material to be attached over said two tips for additional traction when said cane is utilized as a walking cane; and c. a means for attaching a handle grasping surface to said first handle to provide for a non-slip grip.

19. The walking cane that converts into a grasping device and then converts back into a walking cane as defined in of any one of claims 16 through 18 further comprising:

a. a means for releasably attaching a broader base to said walking cane tip to provide for a more stable walking cane base when used as a walking cane; and b. a means for releasing said broader base from said cane tip in order to use said walking cane as a grasping device.

20. The walking cane that converts into a grasping device and then converts back into a walking cane as defined in of any one of claims 16 through 18 further comprising a means between said two struts to prevent said struts from separating when used as a walking cane.

* * * * *